US008438860B2

(12) United States Patent
Albayrak et al.

(10) Patent No.: US 8,438,860 B2
(45) Date of Patent: May 14, 2013

(54) HEATING APPARATUS HAVING AT LEAST TWO THERMOELECTRIC MODULES WHICH ARE CONNECTED IN SERIES

(75) Inventors: Hasan Gökcer Albayrak, Berlin (DE); Klaus Grunert, Berlin (DE); Reinhardt Ruhm, Berlin (DE); Edmund Seiffert, Berlin (DE); Günter Steffens, Dallgow-Döberitz (DE); Andreas Stolze, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 573 days.

(21) Appl. No.: 12/445,769

(22) PCT Filed: Oct. 23, 2007

(86) PCT No.: PCT/EP2007/061315

§ 371 (c)(1),
(2), (4) Date: Aug. 19, 2010

(87) PCT Pub. No.: WO2008/049820

PCT Pub. Date: May 2, 2008

(65) Prior Publication Data

US 2011/0016889 A1 Jan. 27, 2011

(30) Foreign Application Priority Data

Oct. 24, 2006 (DE) ..... 10 2006 050 055

(51) Int. Cl.
*F25B 21/02* (2006.01)

(52) U.S. Cl.
USPC ..... 62/3.2; 62/3.7

(58) Field of Classification Search ..... 62/3.7, 62/3.2, 3.3, 3.6; 34/278, 596; 165/54, 247; 454/159, 236

See application file for complete search history.

(56) References Cited

U.S. PATENT DOCUMENTS

| | | | | |
|---|---|---|---|---|
| 3,694,625 | A | 9/1972 | Cole | |
| 3,821,881 | A * | 7/1974 | Harkias | 62/3.6 |
| 4,301,658 | A * | 11/1981 | Reed | 62/3.3 |
| 5,653,111 | A * | 8/1997 | Attey et al. | 62/3.7 |
| 5,653,741 | A * | 8/1997 | Grant | 607/114 |
| 5,761,908 | A * | 6/1998 | Oas et al. | 62/3.2 |
| 6,028,263 | A * | 2/2000 | Kobayashi et al. | 136/201 |
| 6,370,882 | B1 * | 4/2002 | Adamski et al. | 62/3.6 |
| 6,393,842 | B2 * | 5/2002 | Kim et al. | 62/3.4 |
| 6,438,964 | B1 * | 8/2002 | Giblin | 62/3.5 |
| 6,481,213 | B2 * | 11/2002 | Carr et al. | 62/3.2 |
| 6,571,564 | B2 * | 6/2003 | Upadhye et al. | 62/3.3 |
| 6,877,248 | B1 * | 4/2005 | Cross et al. | 34/275 |
| 7,454,927 | B2 * | 11/2008 | Luckman et al. | 68/13 R |
| 2008/0006308 | A1 | 1/2008 | Classen et al. | |

FOREIGN PATENT DOCUMENTS

| | | |
|---|---|---|
| DE | 4231702 C2 | 3/1994 |
| DE | 10039444 A1 | 2/2002 |

* cited by examiner

*Primary Examiner* — Mohammad M Ali

(74) *Attorney, Agent, or Firm* — James E. Howard; Andre Pallapies

(57) ABSTRACT

A heating apparatus including at least two thermoelectric modules connected in series, and at least one switching arrangement connected in parallel with one of the at least two thermoelectric modules such that electrical current flows via the at least one switching arrangement in an event of a failure of the one of the at least two thermoelectric modules.

20 Claims, 1 Drawing Sheet

HEATING APPARATUS HAVING AT LEAST TWO THERMOELECTRIC MODULES WHICH ARE CONNECTED IN SERIES

The invention relates to a heating apparatus having at least two thermoelectric modules which are connected in series.

BACKGROUND OF THE INVENTION

In a domestic appliance, for example a tumble dryer, thermoelectric modules which are connected in series can be arranged as a heating apparatus. If one of these modules fails, the entire heating apparatus fails.

These types of thermoelectric modules can be embodied as Peltier elements for example which are used in a Peltier heat pump of a tumble dryer.

SUMMARY OF THE INVENTION

The object of the present invention is to create a heating apparatus which can be prevented from failing when one thermoelectric module fails.

This object is achieved by a heating apparatus which has the features claimed in claim 1 and a domestic appliance which has the features claimed in claim 7.

An inventive heating apparatus comprises are least two thermoelectric modules connected in series. A switching arrangement, which is embodied such that electric current flows via the switching arrangement in the event of a fault, is connected in parallel to at least one thermoelectric module. This embodiment enables the continued operation of the heating apparatus to be guaranteed even if the thermoelectric module fails. Even if one or more thermoelectric modules of the heating apparatus fail, this enables the energy supply network of the further thermoelectric modules connected in series with it to be guaranteed and thus the operation of the heating apparatus to be maintained.

Preferably a separate switching arrangement is connected in parallel to each thermoelectric module. Regardless of which or how many of the thermoelectric modules fail at the same time or after one another, the continued heating function of the heating apparatus can still be guaranteed.

Preferably a switching arrangement has just one electronic component. This enables the switching arrangement to be embodied very simply yet still effectively. In addition this enables an embodiment with minimum components and thus minimum costs to be guaranteed. Preferably the switching arrangement includes a resistor, especially an NTC thermistor. Should a thermoelectric module fail, the electrical current could then flow via the NTC thermistor to the next thermoelectric element. Although this would result in a slight reduction in the performance of the appliance, the basic function would however continue to be guaranteed despite the defect of one or more of the modules.

There can also be provision for a switching arrangement to feature a switch. For example the switch can be embodied as a temperature switch or as a current-dependent switch. In an embodiment as a temperature switch, if there is a possible defect of an assigned thermoelectric module, the reduction in temperature can be made to close this temperature switch and thus short circuit the assigned thermoelectric module. This can also guarantee the current flow to the downstream thermoelectric module and maintain the operability of the heating apparatus.

In an embodiment of the switch as a current-dependent switch there is provision for this switch to close if no current flows through the thermoelectric module.

The invention further relates to a domestic appliance for the care of items of laundry, especially a tumble dryer or a washer-dryer, with an inventive heating apparatus or an advantageous embodiment thereof. A domestic appliance embodied in this way allows said appliance to continue to function if one or more thermoelectric modules fails and at least one of these modules is still capable of functioning. Although the drying time of a domestic appliance embodied as a tumble dryer may become longer when one or more of these thermoelectric modules of the heating apparatus fail, the domestic appliance can at least continue to be used until it is repaired.

Preferably the thermoelectric modules are embodied as Peltier elements and assigned to a Peltier heat pump of the domestic appliance.

BRIEF DESCRIPTION OF THE DRAWINGS

Exemplary embodiments of the invention are explained below in more detail on the basis of schematic diagrams. The figures are as follows.

In the figures the same elements or those with the same function have been labeled with the same reference symbols.

DETAILED DESCRIPTION OF THE EXEMPLARY EMBODIMENTS OF THE PRESENT INVENTION

Figure 1:
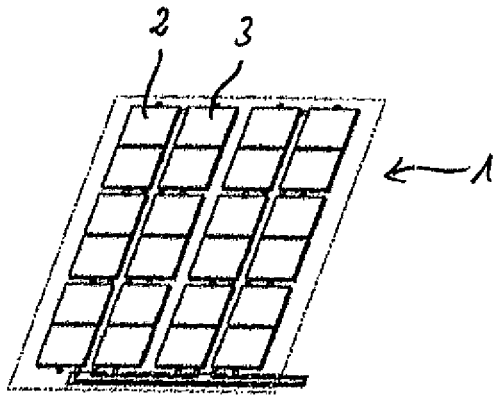
FIG. 1 a diagram of a heating apparatus in accordance with an exemplary embodiment.

FIG. 1 shows a heating apparatus 1 which is arranged in a tumble dryer. The heating apparatus 1 comprises a plurality, in the exemplary embodiment 24, thermoelectric modules which are connected in series and of which the thermoelectric modules 2 and 3 are shown in greater detail as examples. The thermoelectric modules 2, 3 are embodied as Peltier elements and are assigned to a Peltier heat pump of the tumble dryer.

All thermoelectric modules 2, 3 of the heating apparatus 1 are connected in series with one another. Connected in parallel to each of the thermoelectric modules 2, 3 is a respective switching arrangement.

Figure 2:
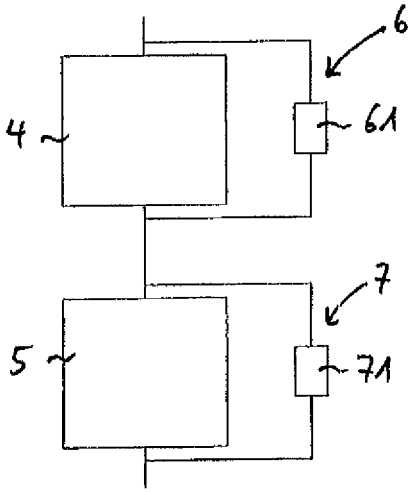
FIG. 2 an enlarged part section of the heating apparatus in FIG. 1 in accordance with a first exemplary embodiment.

FIG. 2 shows a part section of the diagram depicted in FIG. 1, in which for example two further thermoelectric modules 4 and 5 are indicated in greater detail. Connected in parallel with the thermoelectric module 4 is a switching arrangement 6 and a further switching arrangement 7 is connected in parallel to the thermoelectric module 5. The two switching arrangements 6 and 7 each have just one electronic component. In the exemplary embodiment the switching arrangement 6 includes an NTC thermistor 61 and switching arrangement 7 likewise an NTC thermistor 71. If for example thermoelectric module 4 now fails, the electrical current will be routed via the switching arrangement 6 and thus via the NTC thermistor 61 to the downstream thermoelectric module 5.

Figure 3:
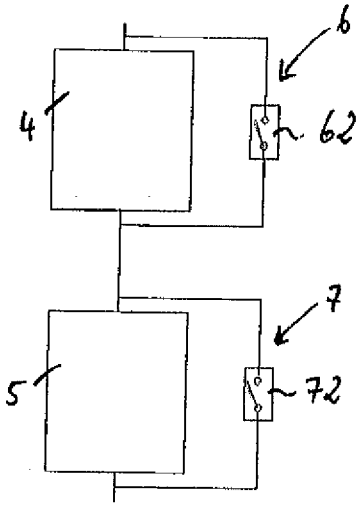
FIG. 3 an enlarged part section of the heating apparatus in FIG. 1 in accordance with a second exemplary embodiment.

A further embodiment is shown in FIG. 3. This diagram too shows an enlarged part section of the diagram in accordance with FIG. 1, in which in the switching arrangements 6 and 7, instead of the NTC thermistors 61 and 71, once again just a single component is connected in each case. Thus in the embodiment according to FIG. 3, both the switching arrangement 6 and also the switching arrangement 7 include a temperature switch 62 or a temperature switch 72. If for example the thermoelectric module 4 fails in this embodiment, a reduction in temperature occurs which leads to the temperature switch 62 closing and the current flowing via the switching arrangement 6 and thus also via the closed temperature switch 62 to the downstream thermoelectric module 5.

The invention claimed is:

1. A heating apparatus comprising:

a first thermoelectric module and a second thermoelectric module connected to each other in series; and a first switching arrangement connected in parallel with the first thermoelectric module such that electrical current flows via the first switching arrangement to the second thermoelectric module in an event of a failure of the first thermoelectric module.

2. The heating apparatus as claimed in claim 1, further comprising a second switching arrangement separate from the first switching arrangement, the second switching arrangement being connected in parallel to the second thermoelectric module.

3. The heating apparatus as claimed in claim 1, wherein the first switching arrangement includes only one component.

4. The heating apparatus as claimed in claim 1, wherein the first switching arrangement is a thermistor.

5. The heating apparatus as claimed in claim 4, wherein the thermistor is a negative temperature coefficient (NTC) thermistor.

6. The heating apparatus as claimed in claim 1, wherein the first switching arrangement is a switch.

7. The heating apparatus as claimed in claim 6, wherein the switch is one of a temperature switch and a current-dependent switch.

8. The heating apparatus as claimed in claim 1, wherein the first thermoelectric module is a Peltier element.

9. The domestic appliance for care of items of laundry, the domestic appliance comprising the heating apparatus as claimed in claim 1.

10. The domestic appliance as claimed in claim 9, wherein the domestic appliance is a tumble dryer.

11. The domestic appliance as claimed in claim 9, wherein the domestic appliance is a washer-dryer.

12. The domestic appliance as claimed in claim 9, wherein the first thermoelectric module is a Peltier element, and wherein the Peltier element is assigned to a Peltier heat pump of the domestic appliance.

13. The domestic appliance as claimed in claim 9, wherein each of the first and second thermoelectric modules is a Peltier element, and wherein each of the Peltier elements is assigned to a Peltier heat pump of the domestic appliance.

14. The heating apparatus as claimed in claim 1, wherein the first switching arrangement automatically switches upon the failure of the first thermoelectric module to direct the electrical current via the first switching arrangement to the second thermoelectric module.

15. A heating apparatus for a domestic appliance, comprising:

a plurality of thermoelectric modules connected in series; and a plurality of switching arrangements, wherein each switching arrangement of the plurality of switching arrangements is connected in parallel with a corresponding thermoelectric module of the plurality of thermoelectric modules such that electrical current flows via the switching arrangement to another one of the plurality of thermoelectric modules upon a failure of the corresponding thermoelectric module.

16. The heating apparatus as claimed in claim 15, wherein the switching arrangement automatically switches upon the failure of the corresponding thermoelectric module to direct the electrical current via the switching arrangement to the another one of the plurality of thermoelectric modules.

17. A heating apparatus for a domestic appliance, comprising:

a first thermoelectric module;

a second thermoelectric module connected in series with the first thermoelectric module; and a switching arrangement connected in parallel with the first thermoelectric module such that electrical current flows via the switching arrangement to the second thermoelectric module upon a failure of the first thermoelectric module.

18. A domestic appliance for care of items of laundry, the domestic appliance comprising the heating apparatus as claimed in claim 17.

19. The domestic appliance as claimed in claim 18, wherein the domestic appliance is a laundry dryer.

20. The heating apparatus as claimed in claim 17, wherein the switching arrangement automatically switches upon the failure of the first thermoelectric module to direct the electrical current via the switching arrangement to the second thermoelectric module.

* * * * *

UNITED STATES PATENT AND TRADEMARK OFFICE

CERTIFICATE OF CORRECTION

PATENT NO. : 8,438,860 B2
APPLICATION NO. : 12/445769
DATED : May 14, 2013
INVENTOR(S) : Albayrak et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1056 days.

Signed and Sealed this
Eighth Day of September, 2015

Michelle K. Lee

Michelle K. Lee
*Director of the United States Patent and Trademark Office*